US006280324B1

(12) United States Patent
Tenenbaum

(10) Patent No.: US 6,280,324 B1
(45) Date of Patent: Aug. 28, 2001

(54) METHOD AND TICKET FOR GAME OF CHANCE

(76) Inventor: Harvey Tenenbaum, 1232 Kingston Rd., Toronto Ontario (CA), M1N 1P3

( * ) Notice: Subject to any disclaimer, the term of this patent is extended or adjusted under 35 U.S.C. 154(b) by 0 days.

(21) Appl. No.: 09/409,075

(22) Filed: Sep. 30, 1999

(51) Int. Cl.[7] ..... A63F 9/22; A63F 3/06

(52) U.S. Cl. ..... 463/16; 463/17; 283/117; 283/901; 283/903

(58) Field of Search ..... 463/16, 17; 283/903, 283/117, 901

(56) References Cited

U.S. PATENT DOCUMENTS

| | | | | |
|---|---|---|---|---|
| 4,275,456 | * | 6/1981 | Tanaka et al. | 364/900 |
| 4,288,077 | * | 9/1981 | Rose et al. | 273/246 |
| 4,781,377 | * | 11/1988 | McVean et al. | 273/86 R |
| 5,129,652 | * | 7/1992 | Wilkinson | 273/139 |
| 5,489,096 | * | 2/1996 | Aron | 273/138 R |
| 5,518,239 | * | 5/1996 | Johnston | 273/139 |
| 5,564,701 | * | 10/1996 | Dettor | 463/16 |
| 5,746,657 | * | 5/1998 | Ueno | 463/41 |
| 5,957,775 | * | 9/1999 | Cherry | 463/16 |
| 5,971,854 | * | 10/1999 | Pearson et al. | 463/41 |
| 5,976,019 | * | 11/1999 | Ikeda et al. | 463/61 |
| 6,019,369 | * | 2/2000 | Nakagawa et al. | 273/246 |
| 6,102,797 | * | 8/2000 | Kail | 463/16 |

FOREIGN PATENT DOCUMENTS

| | | | |
|---|---|---|---|
| 2 130 746 | 11/1972 | (FR) | B42D/15/00 |
| WO 96 05897 | 2/1996 | (WO) | A63F/3/00 |

* cited by examiner

*Primary Examiner*—Valencia Martin-Wallace
*Assistant Examiner*—Carmen D. White
(74) *Attorney, Agent, or Firm*—Bereskin & Parr

(57) ABSTRACT

A method of operating a computer system to provide a game of chance for players, based on a horse race in which horses are assigned post positions, in which a ticket is provided having two columns, one for horse post positions and the second containing a number of rows, each containing entry locations for all possible finishing positions. The player marks in each row one finishing position for each horse, a different finishing position for each row, thus producing a player data set, before post positions are assigned to the horses. The player data sets are entered in a central computer. Horse post positions are then drawn and a post position data set is entered in the computer. After the race is run, an outcome data set is entered in the computer and is compared with a combination of the player data set and the post position data set to see whether any player data sets correspond to the outcome data set.

9 Claims, 2 Drawing Sheets

METHOD AND TICKET FOR GAME OF CHANCE

FIELD OF THE INVENTION

This invention relates to a method of operating a game of chance, to a ticket used in such method, and to a method of operating a computer to utilize the ticket and perform the game.

BACKGROUND OF THE INVENTION

Lottery games are wide spread in many countries. A very common type of lottery game involves selecting a set of numbers at random. The numbers are marked on a computer readable ticket, with a computerized print-out then being provided at the lottery sales outlet, while the computer records each combination of numbers. The entries on each ticket sold at each sales outlet are transmitted to a cental computer and recorded there.

A random draw is then performed, commonly by selecting (with a special machine) ping pong balls from a collection of ping pong balls having numbers marked on them. The process of drawing or selecting the ping pong balls is not particularly exciting and has no symbiotic effect in aiding other fields of activity.

BRIEF SUMMARY OF THE INVENTION

Accordingly, it is an object of the invention in one aspect to provide a game of chance similar to a lottery in which entrants select a set of numbers at random, and then a set of numbers is drawn from a collection of numbers, so that the person who has chosen a set corresponding to the drawn set wins the lottery. However, in the method of the invention, the set of numbers selected by an entrant is based on the post positions and expected finishing positions of horses in a horse race, while the set of numbers corresponding to the set "drawn" in a conventional lottery is obtained from the post positions and actual finishing positions of the horses in the race. The method is arranged such that it is based entirely on luck, with no element of skill involved, so as to eliminate unfairness toward persons with little knowledge of horse racing.

Because the winning set of numbers is based on the finishing positions of horses in the race, it is far more exiting than watching ping pong balls being blown into a line of balls. In addition, the method has the effect of encouraging interest in a worthwhile activity, namely horse racing, which has existed for hundreds if not thousands of years.

In one aspect the invention provides a method of operating a game of chance for players, based on a horse race in which horses are assigned post positions 1 to X, said method comprising (a) providing a ticket having a first column containing a plurality of rows, one row for each horse number 1 to X; (b) each row containing a set of entry locations for finishing positions, one finishing position for each horse number 1 to X; (c) having a player mark in each row of said column one expected finishing position for a horse, a different finishing position for each row, thereby producing a player data set, all prior to assigning post positions to said horses; (d) entering each player data set in a central computer and providing each player with a receipt showing such player's data set; (e) after said horses have been assigned said post positions, entering said post positions in said central computer to provide a post position data set therein; (f) after the race is run, entering in said central computer an outcome data set comprising the actual finishing position of each horse matched to the post position number for such horse; (g) and comparing the outcome data set with each player data set to determine whether any player data sets correspond to said outcome data set.

In another aspect the invention provides a ticket for a game of chance, based on a horse race in which horses are assigned post position numbers, said ticket comprising a plurality of rows, one row for each post position number, each row containing a set of entries for finishing positions, one finishing position for each post position number:

In yet another aspect the invention provides a method of operating a computer system having a central computer and a sales outlet computer linked to central computer by a communication link, said method comprising: (a) entering in said sales outlet computer a player data set comprising one expected finishing position for each of a plurality of horses, a different finishing position for each horse, prior to assigning post positions to said horses; (b) transmitting said player data set from said sales outlet computer over said communication link to said central computer; (c) providing each player with a receipt showing such players data set; (d) after said horses have been assigned post positions, entering said post positions in said central computer to provide therein a post position data set; (e) after a horse race involving said horses has been run, entering in said central computer an outcome data set comprising the actual finishing position of each horse matched to the post position number for such horse; (f) and comparing said outcome data set with each player data set to determine whether any player data sets correspond to said outcome data set.

DETAILED DESCRIPTION OF PREFERRED EMBODIMENTS

Figure 1:
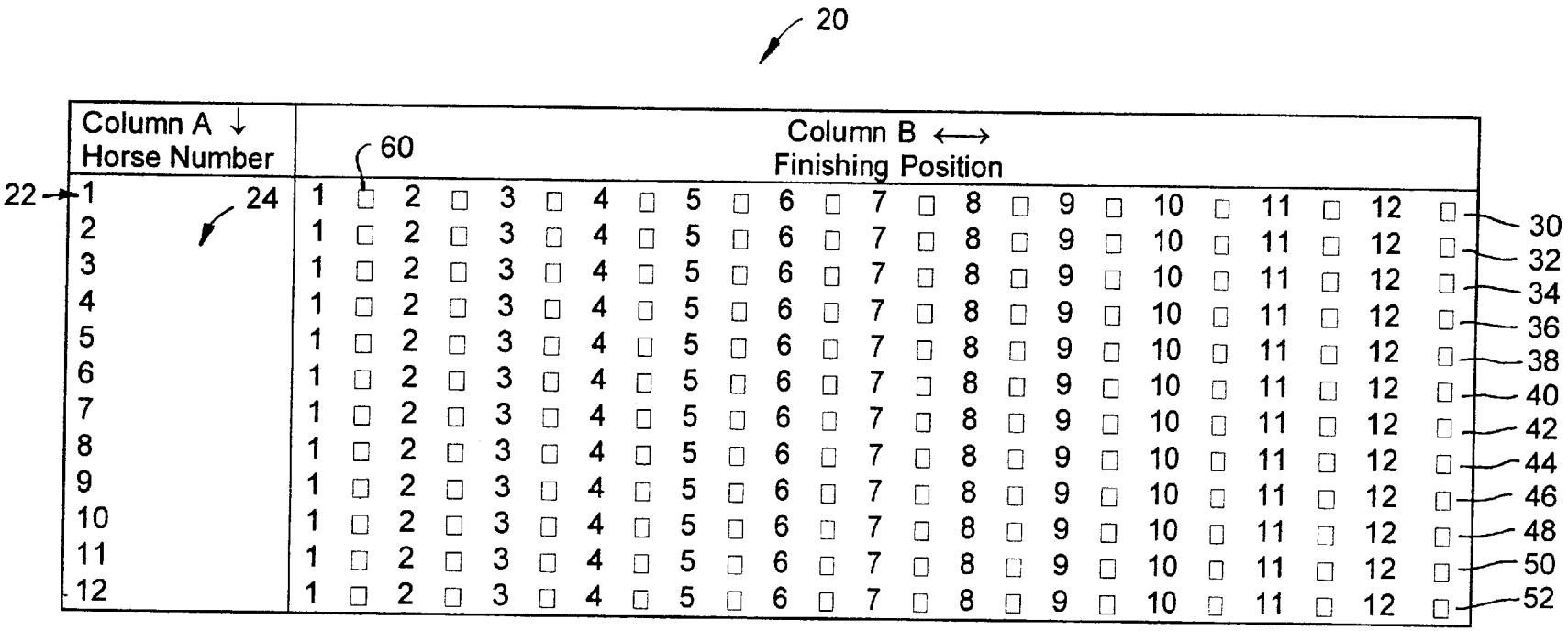
FIG. 1 shows a blank ticket for the game of chance of the invention, ready to be filled in by a player.

Reference is first made to FIG. 1, which shows a ticket 20 according to the invention. The ticket 20 has a first column (labelled column A) containing (for example) a set of numbers 1 to 12, arranged in a column 22 with a space 24 beside each number.

The ticket 20 also contains a second column, labelled column B, and marked "finishing position". Column B contains 12 rows 30 to 52 inclusive. Each row 30 to 52 contains all of the numbers 1 to 12 from the first column A, arranged in a row and with an empty box 60 beside each number.

Normally in horse racing, horses are entered in a race well before the race, and each horse is assigned a post position a few days before the race. The post positions are assigned at random, usually by a random draw.

According to the invention, a player must purchase a ticket 20 and therefore enter the "lottery" before the horse post positions are drawn. At the time when the ticket is purchased, the player simply marks one box 60 in each of row 30 to 52, indicating the player's expected finishing position for each horse numbered in Column A, for the race which is to follow. Since the identity of the horse which will correspond to each number in Column A is not known at the time when the ticket is filled out by the player (since this time is before post positions have been drawn), the selection of finishing positions is purely random and cannot be based on the ability of the horses in the race.

The predicted finishing positions for the horses in column A, which has been filled out in column B by each player, will be referred to as a player data set.

After the player has marked in column B one predicted finishing position for each of the column A numbered horses (i.e. has completed a player data set), the player presents his/her ticket to the sales outlet from which he has purchased his ticket, for computer entry (usually by scanning). Normally the sales outlet will contain a computer 70 (FIG. 2) which will have a printer 72 which prints a computerized copy of the ticket which is given to the player. A typical computerized printed ticket copy is shown at 74 in FIG. 3. In Column B of ticket 74, only the selected numbers in each row of Column B are printed, as shown in FIG. 3. In addition each ticket 74 may if desired (but not necessarily) have an identification printed on it, such as a serial number 76. The identifier 76 not only distinguishes each ticket from all other tickets, but also serves (as is conventionally known) to identify the outlet from which the ticket was sold, and the time of sale of the ticket 74.

When the printed ticket 74 is produced, at the same time computer 70 transmits via communication link 78 the player data set, together with the ticket identifier 76, to a central computer 80 which is connected to all sales outlets. At central computer 80, the player data set, together with the ticket identifier 76, is entered into a main memory 82, which normally will contain all of the player data sets.

As discussed, entries for the lottery or game in question will end before the horse post positions are drawn. After ticket sales have closed, the horse post positions are drawn, and an identification of each horse with its post position is entered into memory 84 of central computer 80 (memory 84 may be part of memory 82). Alternatively, the identification of each horse with its post position number may be entered into and become part of each player data set in memory 82.

Figure 2:
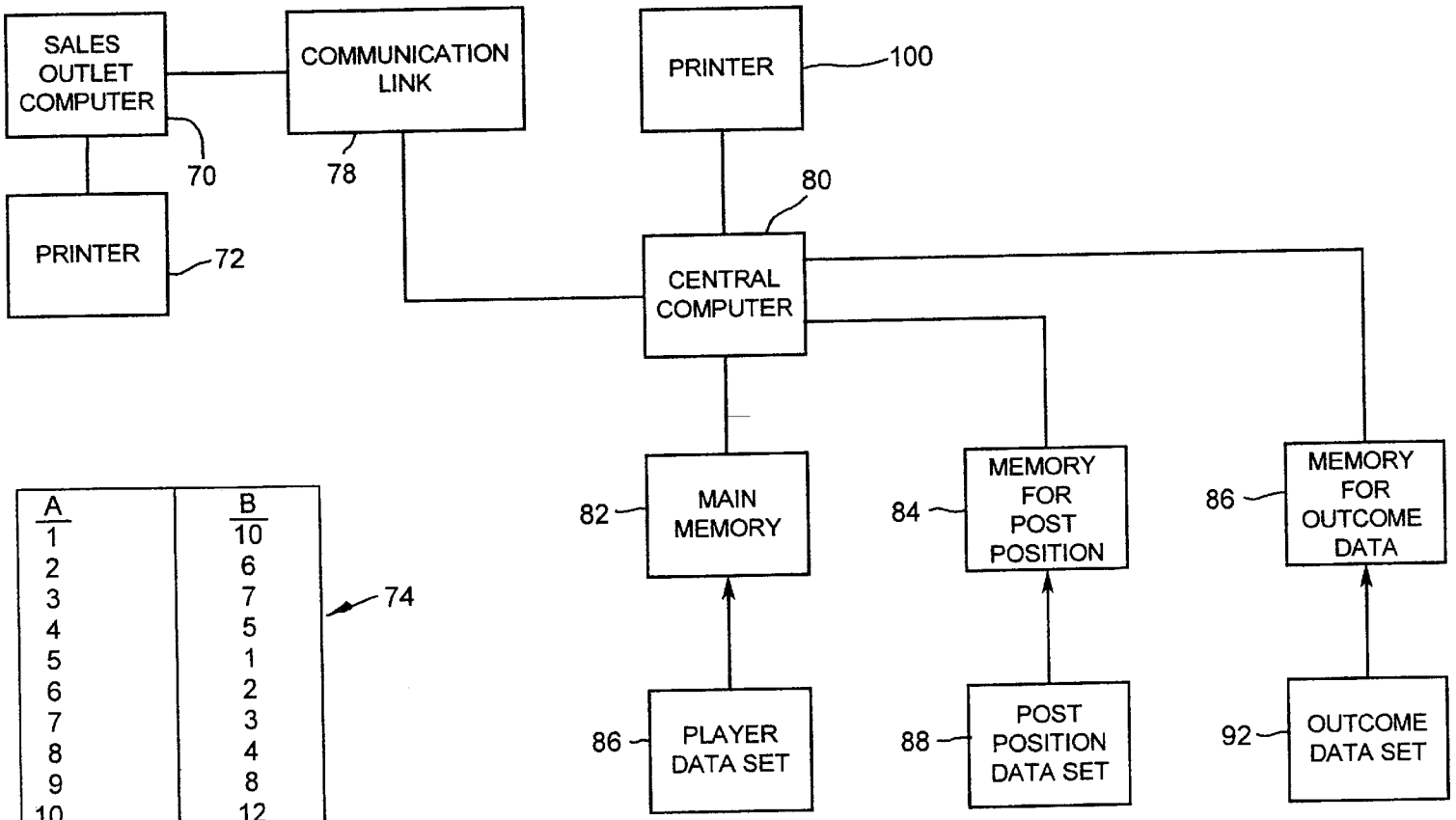
FIG. 2 shows a computer system for performing the method of the invention.
Figure 3:
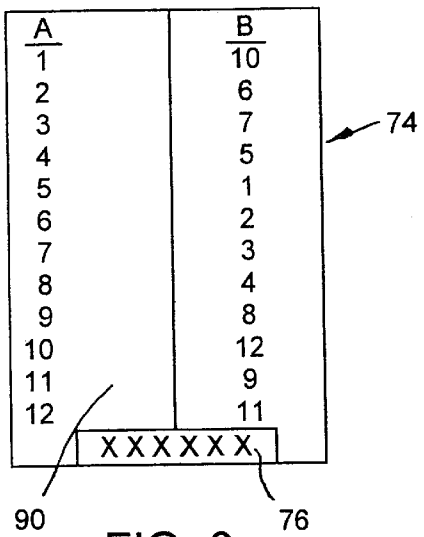
FIG. 3 shows a typical ticket which may be printed by the computer system of FIG. 2 and given to a player.

In FIG. 2, the player data sets entered in the main memory are diagrammatically indicated at 86, while the data set comprising the horse names and their associated post positions (contained in memory 84) is diagrammatically indicated at 88.

In addition, the user may himself/herself fill in the horse identifications (e.g. the horses' names) in Column A in ticket 74, each name opposite the post position of the horse in question. A column of spaces 90 may be left in Column A of ticket 74 for this purpose. Thus, it will be seen that the numbers 1 to 12 in column A are post positions, but the horse assigned to each post position is not determined until after the ticket 74 is printed; hence the user fills in the horse names after the ticket is printed.

Next, after the race has been run, an outcome data set 92 is produced, comprising the actual finishing positions for each horse which ran. Outcome data set 92 may be entered into a memory 86 of central computer 80 (memory 86 can be part of memory 82).

The central computer 80 then compares the players' data sets 86 (together with the post position data set 88 if this is a separate data set) with the outcome data set 92 to determine whether there is a match between one or more player data sets and the outcome data set 92. If one or more matches exist, the central computer prints at printer 100 the serial number or other identification of the winning ticket or tickets.

The serial number of the winning ticket may then be published, or alternatively (or in addition) the finishing positions of the horses with their post positions can be published, and players themselves can check to see whether they have won.

If players wish, they can watch the race and determine from the results of the race whether they have won, without waiting for the winning numbers to be published.

The method and ticket of the invention have the advantage that they encourage persons to watch horse races, thus increasing attendance at this long standing and meritorious sport and supporting the efforts of breeders and jockey clubs. In addition, the activity is far more interesting than simply picking numbers which have no connection to any physical object and then watching ping pong balls be drawn.

If after the post positions for horses are drawn, any horse is withdrawn from the race, for example because of sickness, injury or other circumstances, then that horse is considered to be "scratched". The "scratched horses" may be given the highest number finishing positions. For example if one horse is scratched, it would be automatically be given a finishing position of twelve. If two or more horses are scratched, then they are given finishing positions of 11 and 12, the higher finishing position number being given to the horse with the highest post number. For example, if post positions 3 and 9 are scratched, these horses would be given finishing positions of 11 and 12 respectively.

If it is desired to improve the odds in favor of a player, only the first 10 (or fewer) horse numbers can be used in determining winning tickets. It will be realized that if 12 horse numbers are used, the odds against winning are factorial 12 to 1, whereas if only 10 numbers are used, the odds are factorial 10 to 1.

If desired, Column A in the ticket 20 can be eliminated, and an be replaced simply by a set of instructions advising the player that the umbers 1 to 12 in each row represent horse numbers 1 to 12, and that a single selection is to be made for each row 30 to 52. Similarly, Column A can be omitted in computerized printout 74, although it is preferably included in both tickets, and at least in ticket 74 for explanatory purposes and also to allow the player to watch the race and to fill in the finishing horse positions in ticket 74.

It will be appreciated that various changes may be made in the method, ticket and computer system described, and all such changes are intended to be included within the scope of the attached claims.

I claim:

1. A method of operating a game of chance for players, based on a horse race in which horses are assigned post positions numbered from 1 to X, said method comprising:

(a) providing a ticket having a first column containing a plurality of rows, one row for each number 1 to X;

(b) each row containing a set of entry locations for finishing positions, each set having an entry location for each number 1 to X;

(c) having a player mark in each row of said column one expected finishing position for a horse, a different finishing position for each row, thereby producing a player data set comprising an expected finishing position associated with each number 1 to X, all prior to assigning post positions to said horses;

(d) entering each player data set in a central computer and providing each player with a receipt showing such player's data set;

(e) after said horses have ben assigned said post positions, entering said post positions assigned to said horses in said central computer to provide a post position data set therein, said post positions corresponding to said numbers 1 to X;

(f) after the race is run, entering in said central computer an outcome data set comprising the actual finishing position of each horse matched to the post position for such horse;

(g) and comparing the outcome data set with each player data set and said post position data set to determine whether any player data sets correspond to said outcome data set.

2. A method according to claim 1 wherein said ticket includes a second column listing said post position numbers.

3. A method according to claim 1 wherein said receipt includes a column listing said post position numbers.

4. A method according to claim 3 wherein said receipt contains a space beside each post position number in said further column, so that a player may enter horse names in said spaces.

5. A method according to claim 1 wherein said central computer includes with each player data set an identifier unique to such player data set.

6. A method according to claim 5 wherein said central computer prints on each receipt a serial number unique to such receipt.

7. A method of operating a computer system having a central computer and a sales outlet computer linked to said central computer by a communication link, said method comprising:

(a) entering in said sales outlet computer a player data set comprising one expected finishing position for each of a plurality of horses having numbers from 1 to X, a different finishing position for each horse, prior to assigning post positions to said horses;

(b) transmitting said player data set from said sales outlet computer over said communication link to said central computer;

(c) providing each player with a receipt showing such player's data set;

(d) after said horses have been assigned post positions, entering said post positions in said central computer to provide therein a post position data set, said post positions corresponding to said numbers from 1 to X;

(e) after a horse race involving said horses has been run, entering in said central computer an outcome data set comprising the actual finishing position of each horse matched to the post position for such horse;

(f) and comparing said outcome data set with each player data set and said post position data set to determine whether any player data sets correspond to said outcome data set.

8. A method according to claim 7 including entering in said cantral computer with each player data set an identifier unique to such data set.

9. A method according to claim 8 including printing said identifier on said receipt.

* * * * *